US006923334B2

(12) United States Patent
Melrose et al.

(10) Patent No.: US 6,923,334 B2
(45) Date of Patent: Aug. 2, 2005

(54) BLOW MOLDED SLENDER GRIPPABLE BOTTLE HAVING DOME WITH FLEX PANELS

(75) Inventors: David M. Melrose, Auckland (NZ); Seungyeol Hong, York, PA (US); Richard K. Ogg, Littlestown, PA (US); George Harrell, York, PA (US); John Vlah, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/686,068

(22) Filed: Oct. 15, 2003

(65) Prior Publication Data

US 2004/0074864 A1 Apr. 22, 2004

Related U.S. Application Data

(63) Continuation of application No. 09/777,720, filed on Feb. 5, 2001, now Pat. No. 6,662,960.

(51) Int. Cl.[7] ..... B65D 90/02
(52) U.S. Cl. ..... 215/381; 220/669
(58) Field of Search ..... 215/381, 382, 215/383–385, 379; 220/660, 666, 669–676; D9/530–541

(56) References Cited

U.S. PATENT DOCUMENTS

| | | | | | |
|---|---|---|---|---|---|
| D61,658 | S | | 11/1922 | Graham | |
| 3,923,178 | A | | 12/1975 | Welker, III | 215/1 C |
| 4,497,855 | A | | 2/1985 | Agrawal et al. | 428/35 |
| 4,749,092 | A | | 6/1988 | Sugiura et al. | 215/1 C |
| 4,805,788 | A | | 2/1989 | Akiho | 215/1 C |
| 4,946,053 | A | * | 8/1990 | Conrad | 215/381 |
| 5,011,648 | A | | 4/1991 | Garver et al. | 264/521 |
| 5,067,622 | A | * | 11/1991 | Garver et al. | 215/381 |
| D322,562 | S | | 12/1991 | Narsutis | D9/397 |
| 5,141,120 | A | | 8/1992 | Brown et al. | 215/1 C |
| 5,141,121 | A | | 8/1992 | Brown et al. | 215/100 A |
| D331,881 | S | | 12/1992 | Garver et al. | D9/553 |
| 5,178,289 | A | | 1/1993 | Krishnakumar et al. | 215/1 C |
| 5,303,834 | A | | 4/1994 | Krishnakumar et al. | 215/1 C |
| 5,381,910 | A | | 1/1995 | Sugiura et al. | 215/1 C |
| 5,392,937 | A | | 2/1995 | Prevot et al. | 215/1 C |
| 5,407,086 | A | | 4/1995 | Ota et al. | 215/1 C |
| 5,472,105 | A | | 12/1995 | Krishnakumar et al. | 215/384 |
| D366,416 | S | | 1/1996 | Semersky | D9/434 |
| D366,831 | S | | 2/1996 | Semersky et al. | D9/434 |
| D374,826 | S | | 10/1996 | Mackinson et al. | D9/542 |
| 5,598,941 | A | | 2/1997 | Semersky et al. | 215/384 |
| 5,690,244 | A | | 11/1997 | Darr | 215/382 |

(Continued)

FOREIGN PATENT DOCUMENTS

| | | |
|---|---|---|
| WO | WO 00/50309 | 8/2000 |
| WO | WO 00/68095 | 11/2000 |
| WO | WO 01/89934 A2 | 11/2001 |

*Primary Examiner*—Lien M. Ngo
(74) *Attorney, Agent, or Firm*—Venable LLP; James R. Burdett; Stuart I. Smith

(57) ABSTRACT

A blow-molded plastic bottle body for use in containing hot-filled beverages. The bottle body has a dome with various interactive functional zones. For example, some of the zones are primarily responsible for accommodating vacuum absorption, while other zones are primarily intended to rigidify the container such as by providing column strength to improve container top loading capability. Although each zone may have a primary function, each zone also aids adjacent zones in providing their functions. Thus, the entire dome, and not merely selected locations, reacts in a progressive manner to the forces generated by the hot-fill process on the bottle body. Preferably, the bottle body is slender and capable of readily being gripped by a single hand, and preferably the flex panels in the dome accommodate at least 90% of the total vacuum absorption required by the bottle.

10 Claims, 7 Drawing Sheets

U.S. PATENT DOCUMENTS

| | | | | | |
|---|---|---|---|---|---|
| 5,704,504 | A | | 1/1998 | Bueno | 215/381 |
| D391,168 | S | | 2/1998 | Ogg | D9/538 |
| 5,740,934 | A | | 4/1998 | Brady | 215/381 |
| 5,762,221 | A | | 6/1998 | Tobias et al. | 215/381 |
| D411,803 | S | | 7/1999 | Guertin | D9/520 |
| D412,119 | S | * | 7/1999 | Guertin | D9/520 |
| 5,971,184 | A | | 10/1999 | Krishnakumar et al. | 215/384 |
| 6,016,932 | A | | 1/2000 | Gaydosh et al. | 215/382 |
| 6,044,996 | A | | 4/2000 | Carew et al. | 215/381 |
| 6,044,997 | A | | 4/2000 | Ogg | 215/381 |
| 6,095,360 | A | | 8/2000 | Shmagin et al. | 215/382 |
| 6,161,713 | A | | 12/2000 | Krich | 215/384 |
| D439,166 | S | | 3/2001 | Denner et al. | D9/538 |
| D449,533 | S | * | 10/2001 | Helps et al. | D9/502 |
| 6,467,639 | B2 | * | 10/2002 | Mooney | 215/384 |
| 2002/0008077 | A1 | * | 1/2002 | Lane et al. | |

* cited by examiner

BLOW MOLDED SLENDER GRIPPABLE BOTTLE HAVING DOME WITH FLEX PANELS

CROSS REFERENCE TO RELATED APPLICATION

The present application is a continuation of application Ser. No. 09/777,720 filed on Feb. 5, 2001, now U.S. Pat. No. 6,662,960.

FIELD OF THE INVENTION

The present invention relates to slender, grippable, blow-molded plastic bottles useful in containing hot-filled beverages.

BACKGROUND OF THE INVENTION

So-called hot-fillable, blow-molded plastic containers are well known in the art. The problems associated with accommodating vacuum deformations associated with hot filling, capping and cooling, and their solutions are also well known. Typically, so-called flex panels are provided in the containers at various locations to accommodate the vacuum that develops in the container as a result of hot fill processing.

Prior art large capacity containers, eg. 64 fluid ounces, have had cylindrical sidewalls and flex panels spaced apart therein. Labels have been applied entirely around the sidewalls over the flex panels to conceal them. Examples of such containers are disclosed in U.S. Pat. No. D.366,416 issued to Semersky; U.S. Pat. No. 5,407,086 issued to Ota et al. and U.S. Pat. No. 5,178,289 issued to Krishnakumar et al.

The handling problems associated with such containers was overcome with the introduction by Graham Packing Company, LP of its commercially successful bottles having sidewalls with grips and associated flex panels. Examples of these containers are disclosed in Graham's U.S. Pat. No. 5,598,941 issued to Semersky et al. and U.S. Pat. No. 5,392,937 issued to Prevot et al. Other sidewall grip container patents include the following: U.S. Pat. No. 5,472,105 issued to Krishnakumar et al. and U.S. Pat. Nos. 5,141,120 and 5,141,121 issued to Brown et al.

One known attempt has been made to provide a large capacity bottle having flex panels in both the dome and the base to accommodate the requisite vacuum absorption function created during hot fill processing. Such a container is disclosed in U.S. Pat. No. 5,067,622 issued to Garver et al. and assigned to Van Dorn. In this patented container, about one-half of the vacuum absorption is provided in the dome, and the remainder is provided by the base. The container does not have any flex panels in the sidewall, and is not readily grippable with one hand due to its relatively large sidewall diameter.

So-called single serve hot-fill slender containers are known. Such containers are relatively long, have small diameters, and have capacities of about 20 fluid ounces. They are readily grippable by one hand placed about either the container sidewall or about the waist located between the dome and the sidewall. Examples of such containers are disclosed in U.S. Pat. No. : D.366,831 issued to Semersky et al.; U.S. Pat. No. 5,762,221 issued to Tobias et al.; and U.S. Pat. Nos. 5,971,184 and 5,303,834 issued to Krishnakumar et al.

At present, there is no known commercially acceptable hot fill, slender, gripable bottle that has a cylindrical labelable body, a gripable waist, and a dome provided with flex panels that are capable of accommodating substantially all of vacuum absorption required by the container when subjected to hot fill processing.

In known hot-fillable containers a series of well-defined, spaced-apart vacuum flex panels are generally provided to compensate for the internal volume reduction. The vacuum flex panels provide a sufficient amount of flexure without adversely affecting the structural integrity of the hot-filled container. The adjacent portions of the container, such as the so-called lands, or columns, which are located between, above, and below the flex panels, are intended to resist any deformation which would otherwise be caused by hot-fill processing. Wall thickness variations, or geometric structures, such as ribs, projections and the like, are often utilized in the structure of a container to prevent unwanted distortion.

An example of a hot-fillable container having flex panels framed within the dome of the container is disclosed by the above referenced Garver '622 patent. Examples of hot-fill containers having a plurality of framed flex-panels in the sidewalls of the containers are provided by the above referenced Semersky '416 and '831 patents, the above referenced Ota '086 patent, the above referenced Krishnakumar '289 and '834 patents and U.S. Pat. No. 5,381,910 issued to Sugiura et al.

As disclosed in the above references, the typical structure for a hot-fillable container is one that has certain pre-defined limited functional areas which flex to accommodate volumetric changes and certain other pre-defined structural areas which frame the periphery of the flex panels and resist deformation. Thus, conventional hot-fill bottles have flex panels with well-defined boundaries which are distinctly visually apparent before and after filling. These containers also have other geometric structures which are completely segregated from the flex panels, which are also distinctly visually apparent prior to filling, and which resist structural change caused by volume reduction. Typically, all of these structures are framed about substantially their entire peripheries and are completely separated from the bottle's aesthetic features. For example, as illustrated in the above referenced Garver patent, flex panels are often indented into the container via stepped transitional framing walls which form sharp-angled junctures with a planar flex panel and the adjacent container wall from which the flex panel is indented.

Other examples of container sidewalls having flexible panels are disclosed in U.S. Pat. No. 4,749,092 issued to Sugiura et al.; U.S. Pat. No. 3,923,178 issued to Welker III; U.S. Pat. No. 4,497,855 issued to Agrawal et al.; U.S. Pat. No. 5,690,244 issued to Darr; U.S. Pat. No. 5,740,934 issued to Brady; and U.S. Pat. No. 5,704,504 issued to Bueno. The Sugiura '092, Welker, Agrawal and Darr patents disclose inwardly deflecting vacuum flex panels which are located between substantially planar lands; the Bueno patent discloses inwardly deflecting panels which are located between angled grooves; and the Brady patent discloses outwardly deflecting panels which intersect at vertically disposed corners.

Although various ones of the above referenced containers may function satisfactorily for their intended purposes, there is a need for a hot-fillable blow molded slender bottle which integrates functional and aesthetic components in such a manner as to provide a package having enhanced visual interest.

OBJECTS OF THE INVENTION

With the foregoing in mind, a primary object of the present invention is to provide a hot-fillable bottle which integrates vacuum absorption, structural reinforcement, and other functional features with aesthetic and ergonomic properties by providing various interactive functional zones in the container structure.

Another object of the present invention is to provide a bottle having a dome with a plurality of alternating unframed flex panels and unframed lands, or columns, which laterally merge directly together, which are jointly reactive to hot-fill process forces acting thereon, and which do not have boundaries that are clearly visually identifiable.

A further object is to provide a slender blow-molded, plastic, hot-fillable bottle having a waist grip structure which cooperates with a novel vacuum reactive dome to enhance both the structural integrity of the container and the visual appearance of the container.

SUMMARY OF THE INVENTION

More specifically, the present invention provides a slender, blow-molded, hot-fill bottle having a body portion with a base, a dome with a finish located above the body portion, and a waist connecting the dome and body portion. The dome is composed of a plurality of upright columns extending lengthwise of the dome in spaced relation between the columns from the waist to the finish and a plurality of recessed panels extending between the waist and the finish for accommodating substantially all of the vacuum induced in the bottle. Selected ones of the recessed panels are outwardly concave and are adapted to flex in a controlled manner in response to vacuum induced in the bottle. The aforedescribed structure is particularly suited for use in a single-serve size bottle which is readily grippable with one hand, which can accommodate a label wrapped about the entire sidewall of the bottle, and which has a dome that accommodates substantially all of the vacuum-induced reduction of internal container volume.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
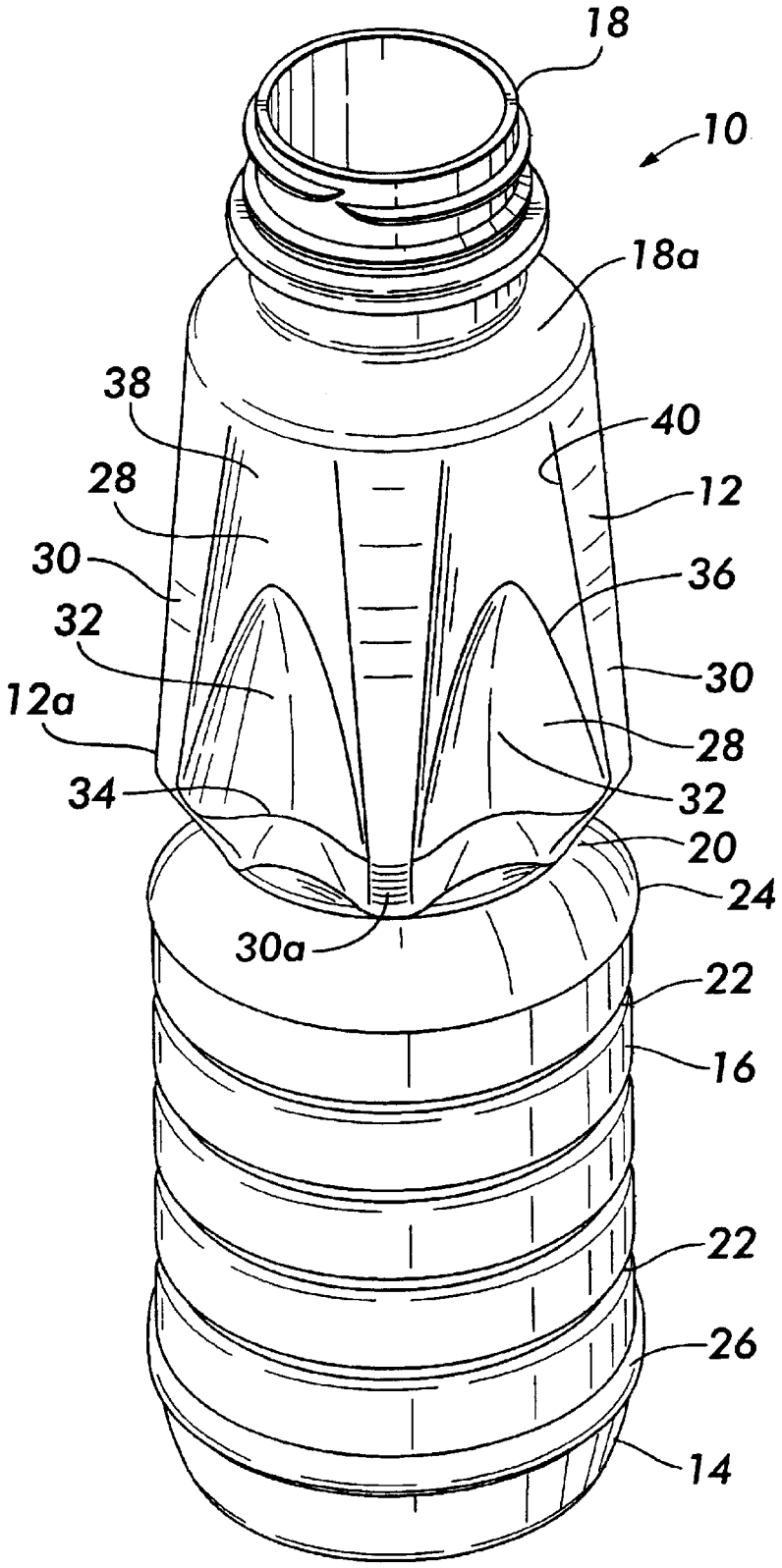
FIG. 1 is a perspective view of a container embodying the present invention.

An embodiment of a blow-molded plastic bottle body, or container body, 10 according to the present invention is illustrated in FIG. 1. The body 10 is utilized to package beverages and is capable of being filled in either high-speed hot-fill or cold fill operations. As is typical with such containers, the body 10 has a dome 12, a close ended base 14 and a sidewall 16 located between the dome and base. An upstanding threaded finish 18 projects from the dome 12 via a substantially annular shoulder 18*a* and cooperates with a closure, such as a cap, (not shown) to seal the bottle body 10 after filling.

An inset grip ring 20 provides the body 10 with a readily grippable waist which is located between, and connects, the dome 12 to the sidewall 16. In addition to providing a structure for permitting convenient and comfortable single-hand gripping of the bottle body 10, the circumferentially-extending grip ring 20 enhances the hoop strength of the bottle and provides resistance to ovalization distortion which may otherwise result due to hot-filling. The grip ring 20 also functions to stiffen the transition between the dome 12 and sidewall 16.

As illustrated, the preferred bottle body 10 has a tubular-shaped sidewall 16 which is reinforced with a plurality of longitudinally-spaced, circumferentially-extending grooves 22 that rigidify the sidewall 16 and prevent it from ovalizing due to forces created by hot-fill processing. Alternatively, the sidewall can be provided using other cross sectional shapes, such as, square, rectangular, oval, or other multi-sided configurations, and other reinforcement structures can be utilized to prevent unwanted deformation of the sidewall. Preferably, a label (not shown) is wrapped around and mounted on the sidewall 16 between upper and lower label bumpers, 24 and 26. An advantage of the above described relatively smooth-surfaced sidewall 16 is that labels are not required to be mounted over flex panels or like structures which tend to negatively affect the aesthetic appearance of labels.

The dome 12 of the present invention integrates various functional and aesthetic features in a unique manner without clearly segregating the features. To this end, the dome 12 is provided with various interactive zones of function. Some of the zones are primarily responsible for accommodating vacuum absorption, while other zones are primarily intended to rigidify the container body such as by providing column strength to improve container top loading capability. Although each zone may have a primary function, each zone also aids adjacent zones in providing their functions. Thus, the entire dome 12, and not merely selected locations, reacts to the forces generated by hot-fill processing of the bottle body 10.

To provide the above stated functions, the dome 12 of the present invention has a plurality of vacuum flex panels 28 and support columns 30 which interact to provide vacuum absorption functions and structural reinforcement functions. The panels 28 are without clearly identifiable boundaries and are thereby considered as being "unframed". As illustrated, the substantially smooth-surfaced flex panels 28 are circumferentially-spaced in the dome 12 in an alternating array with the plurality of circumferentially-spaced, longitudinally-extending elongate columns 30.

Figure 3:
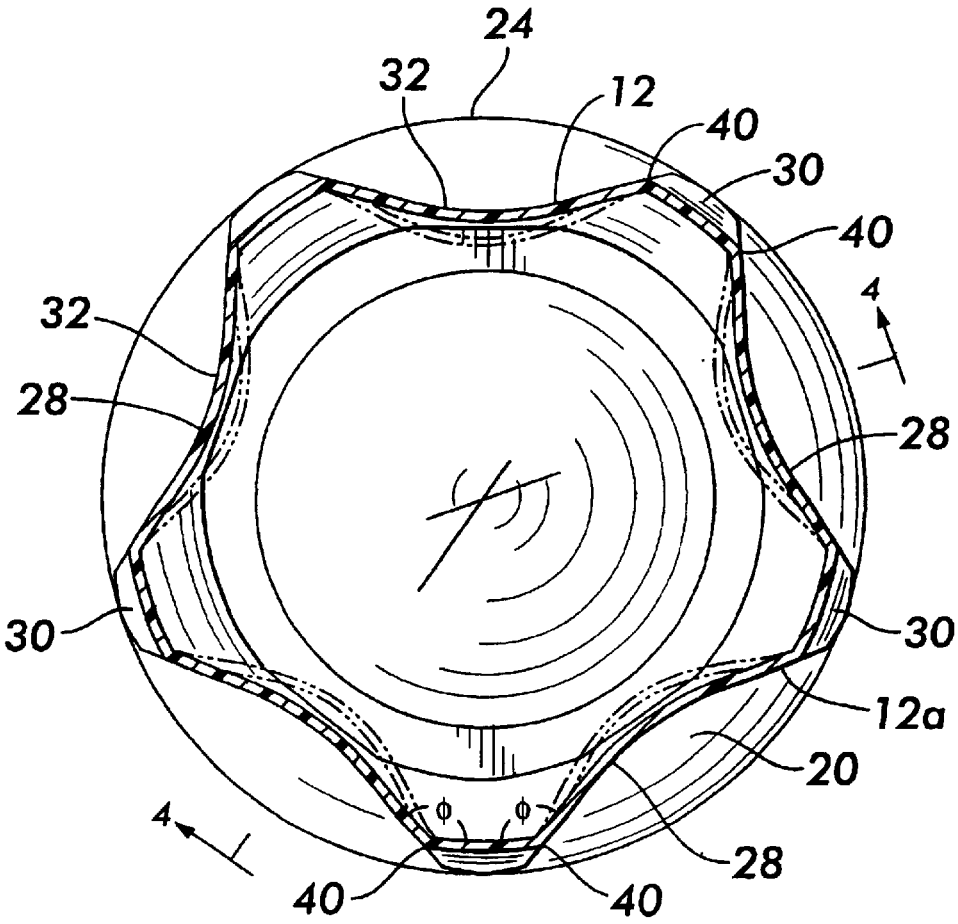
FIG. 3 is a cross-sectional view taken transversely of the dome of the container along line 3—3 shown in FIG. 2.
Figure 4:
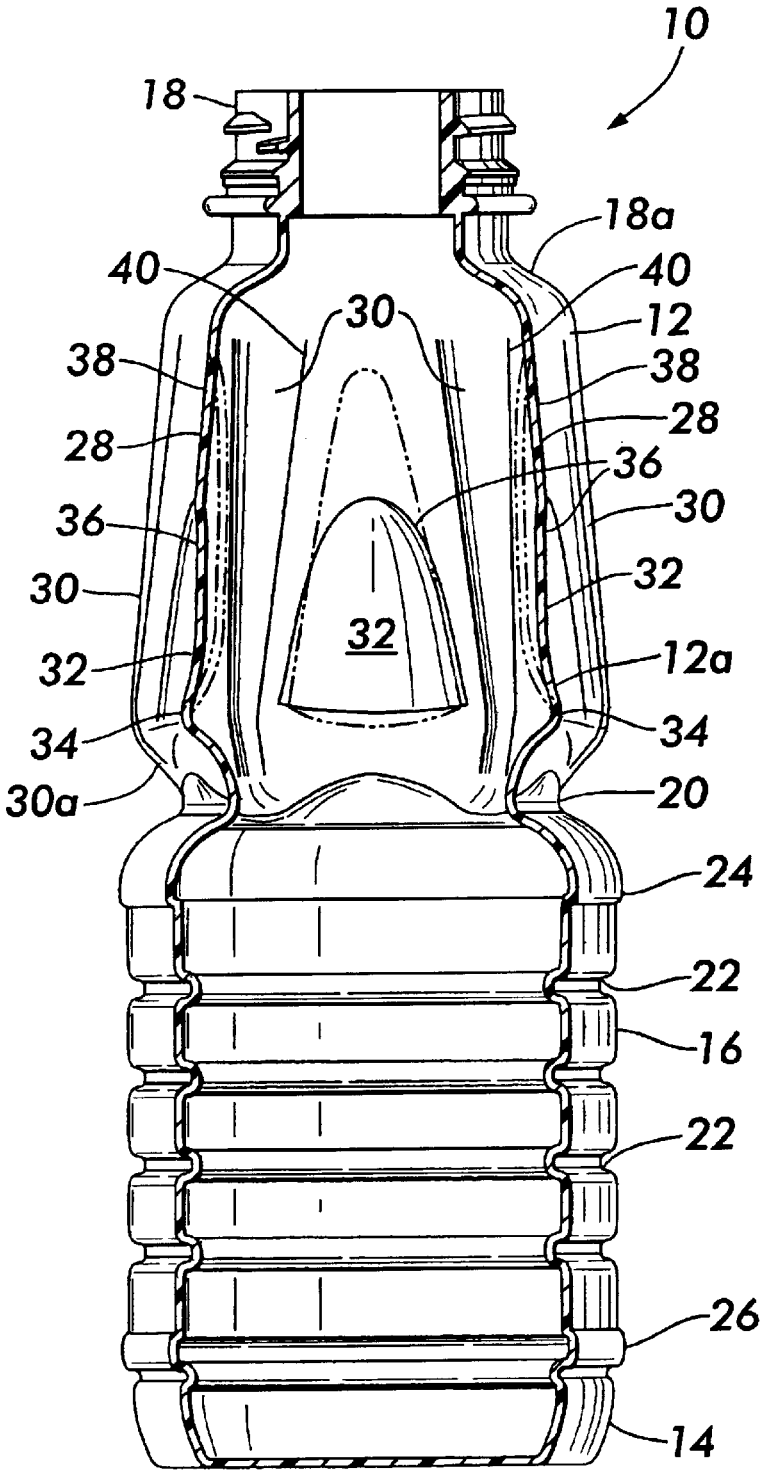
FIG. 4 is a cross-sectional view taken longitudinally of the container along line 4—4 shown in FIG. 3.

In the "as-formed" condition, ie. after blow-molding but before hot-filling, and in the absence of any internal or external applied forces, at least a portion 32 of each panel 28 is formed outwardly concave. This is best illustrated in FIG. 3 in which the horizontal cross section of the dome 12 taken through portions 32 of panels 28 is fluted, or substantially star-shaped. Preferably, as best illustrated in FIG. 4, the as-formed outwardly concave portions 32 of the panels 28 are located in the lower portion 12*a* of the dome 12 adjacent the waist 20 and provide finger receivable grips. Thus, each panel 28 has a lower edge 34 which is outwardly concave and merges directly into the grip ring 20, and each portion 32 has an upper section 36 which, as formed, becomes progressively less concave as the panel 28 extends in a direction toward the finish 18 of the bottle body 10. Preferably, the uppermost section 38 of each panel 28, as formed, bows outwardly.

Each column 30, as formed, tapers inwardly and widens peripherally in an upward direction from the waist as each of the panels 28 narrows correspondingly. For example, see FIG. 2. The angle of taper "t" relative to a central longitudinal axis "A" of the bottle is about 5°, and is preferably in a range of about 1° to about 10°. The columns, as formed, also bow slightly outwardly in transverse cross-section. The columns 30 have lower ends 30*a* adjacent the waist 20 that taper inwardly and merge into the waist 20. Preferably, the columns 30 extend substantially the entire longitudinal extent of the dome 12 except where they gently merge into the panels 28 adjacent the shoulder 18*a*. For example, the columns 30 and panels 28 are not clearly identifiable in a portion of the dome adjacent the shoulder 18*a* where the uppermost section 38 of each panel 28 bows outwardly.

The panels 28 extend and merge directly into adjacent columns 30 without the presence of transitional framing walls as required by prior art conventional flex panels. As a result, a panel-to-column juncture 40 is formed at the interconnection of each adjacent panel 28 and column 30. As best illustrated in FIG. 3, the intersection of the panels 28 and columns 30 intersect at the junctures 40 form an obtuse angle $\phi$. For example, the angle $\phi$ illustrated in FIG. 3 is about 135°. However, the obtuse angle $\phi$ is not constant along the length of the juncture 40; rather, the obtuse angle $\phi$ is greatest in an area where the juncture 40 extends within the uppermost section 38 of each panel 28 and is least where the juncture 40 extends within the inwardly concave portion 32 of each panel 28. Thus, the lack of transitional framing walls forming right-angular junctures between flex panels and adjacent container walls and the changing obtuse angle $\phi$ of the junctures 40 of the present invention enable the panels 28 and columns 30 to jointly respond to a reduction in internal volume of the hot-filled, capped and cooled bottle body 10 and provides an aesthetically pleasing appearance which can be left exposed and not hidden from the ultimate customer by a label as with bottles having conventional flex panels.

When the container body 10 is hot-filled with a beverage, capped and permitted to cool, each panel 28 deflects inwardly, as best illustrated by the dashed lines in FIGS. 3 and 4, to effectively reduce the volume of the bottle body 10. As each panel 28 progressively deflects inwardly, the columns 30 progressively flatten and strengthen to enhance bottle top loading capability. This occurs due to the increase in lateral pinching of the columns 30 as a result of the panels 28 deflecting inwardly. See the dashed lines in FIG. 3. Thus, the intended altered shape of the dome 12 both resists unwanted container distortion and provides enhanced visual aesthetic interest in the container. This structure is referred to as a so called "active-cage," and is disclosed in International Application No. PCT/US00/12625 which was published on Nov. 16, 2000 as WO 00/68095, owned by Graham Packaging Co., L.P. and incorporated by reference herein.

Preferably, the panels 28 deflect inwardly to reduce container volume in a controlled progressive directional manner similar to the flex panels disclosed in International Application No. PCT/NZ00/00019 which was published on Aug. 31, 2000 as WO 00/50309 and which is incorporated by reference herein. To this end, each panel 28 includes a structure which initiates flexure as the hot filled and capped bottle begins to cool. The as-formed inwardly concave portion 32 functions as the initiator of the illustrated panel 28. Thus, the portions 32 of each panel 28 deflect inwardly to reduce the internal volume of the body 10, and thereafter, as the internal volume progressively decreases as the bottle and hot filled beverage cool, further deflection of each panel 28 occurs adjacent the upper sections 36 of portions 32 and continues in a direction toward the uppermost sections 38 of the panel 28, as needed. Thus, depending on filling conditions, ie. filling temperature, beverage type, fill levels, etc., the dome 12 of the present invention can accommodate a wide range of container internal volume reduction while providing an aesthetic appearance throughout such range. The panels 28 of the dome 12 accommodate at least 90% of the total vacuum absorption required by the bottle.

Figure 2:
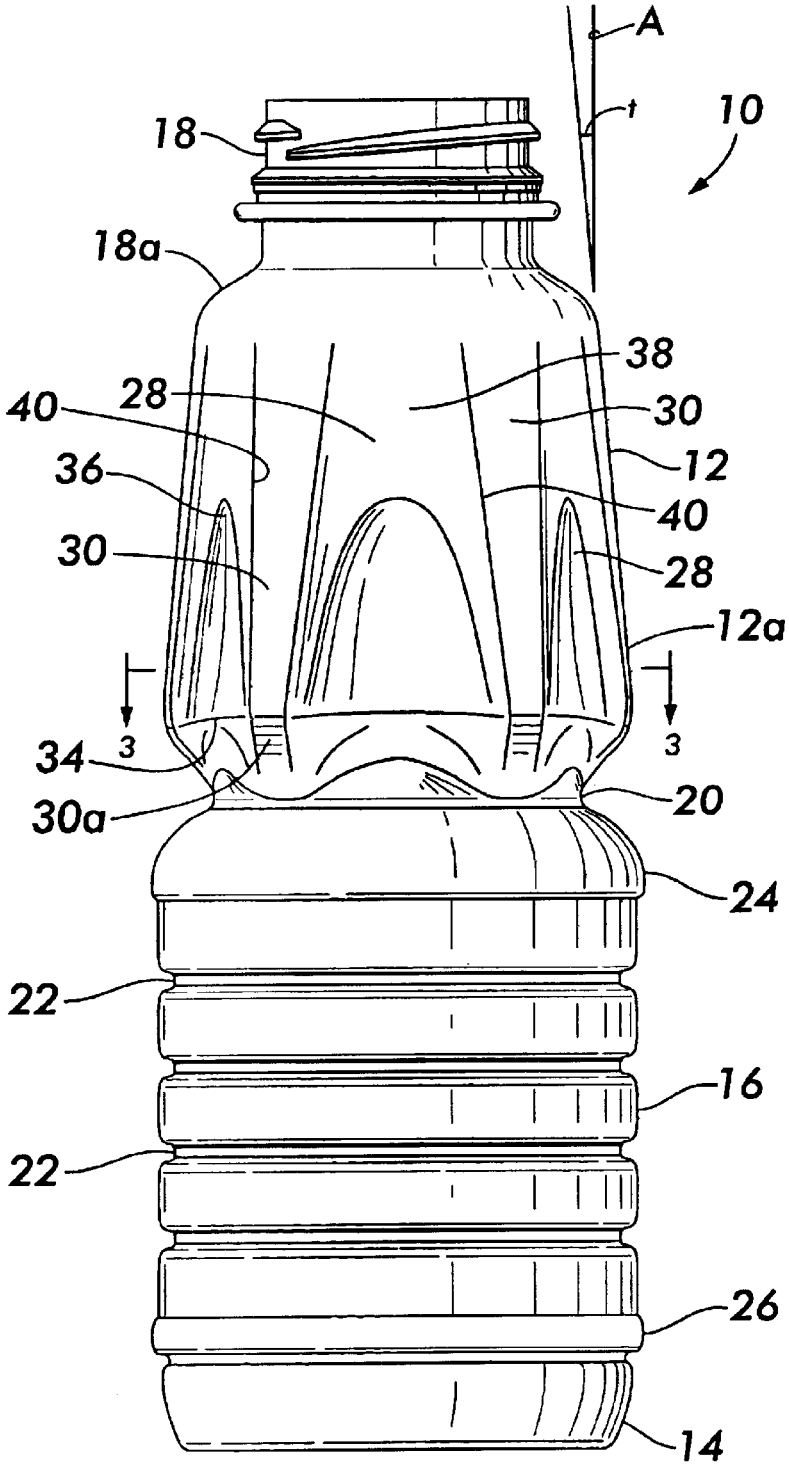
FIG. 2 is an elevational view of the container illustrated in FIG. 1.

The bottle body 10 of the present invention is particularly suited for use in providing grippable slender bottles, such as illustrated in FIGS. 1 and 2 which are drawn to full scale. The bottle body 10 has a predetermined slenderness ratio which, as used herein, is the length of the bottle measured axially from the upper edge of the finish 18 to the bottom of the base 14 divided by the mean diameter of the sidewall 16. In the illustrated bottle 10, the bottle body 10 has an overall height of about 8 inches, an outermost sidewall diameter of less than 3 inches, and provides an intended beverage capacity of about 20 fluid ounces. Its slenderness ratio is about 2.9:1. Of course, container bodies having other sizes and slenderness ratios can be made in accordance with the present invention.

By way of example, and not by way of limitation, the bottle body 10 is manufactured by blow molding in a heat set blow mold an injection molded preform made of about 36 grams of PET. The dome 12 of the bottle body may include any number of panels 28 and columns 30, such as in a range of two through ten. The preferred illustrated embodiment includes five panels 28 and five columns 30. All or selected ones of the panels 28 can be designed to flex in response to vacuum induced in the bottle. The sidewall 16 can be formed with any number of reinforcing circumferential grooves or like reinforcement structures. Preferably, the bottle body has a slenderness ratio of at least 2.5:1 and the dome 12 from shoulder 18*a* to waist 20 constitutes at least about 28% of the overall bottle length.

Figure 5:
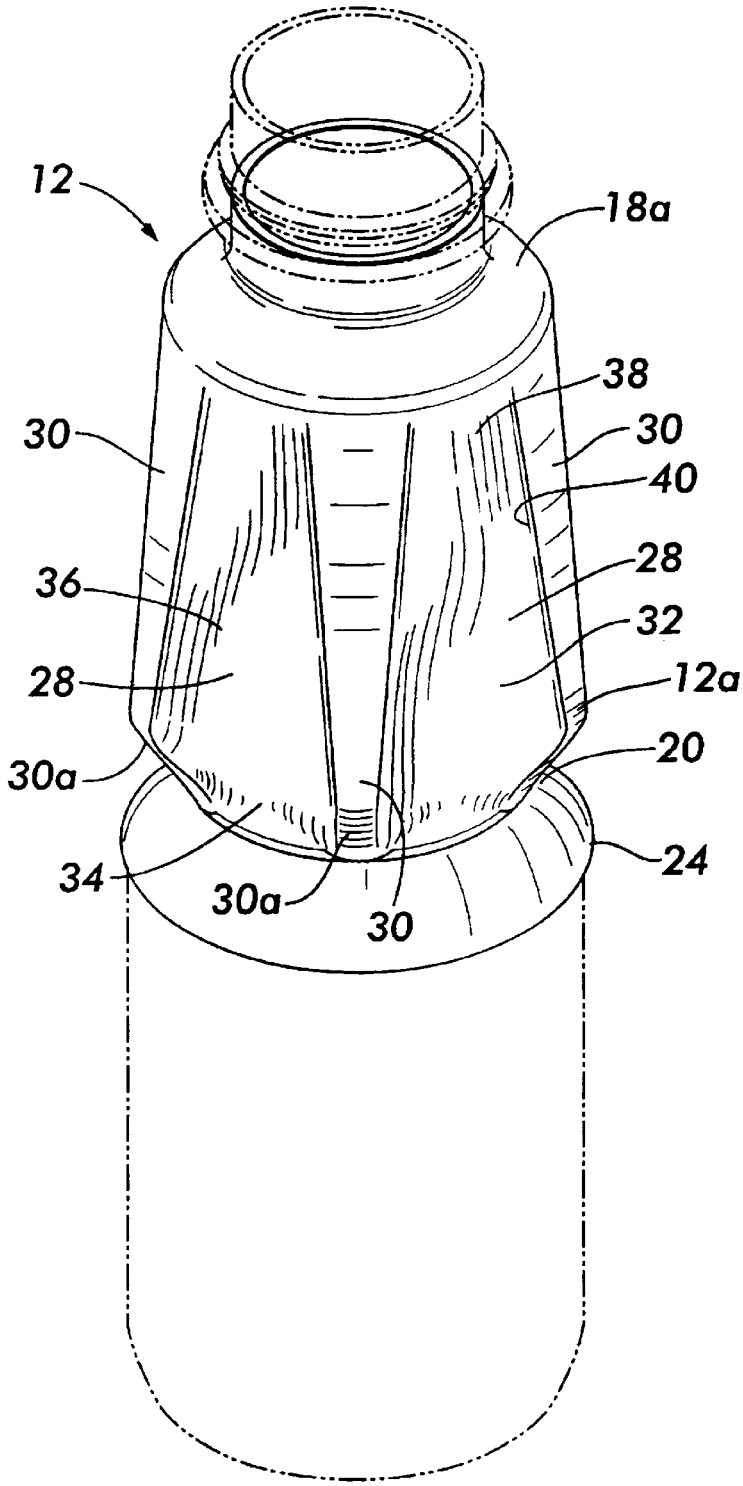
FIG. 5 is a perspective view of the same container dome illustrated in FIG. 1 having alternate shading lines to better illustrate the contours of the panels.
Figure 6:
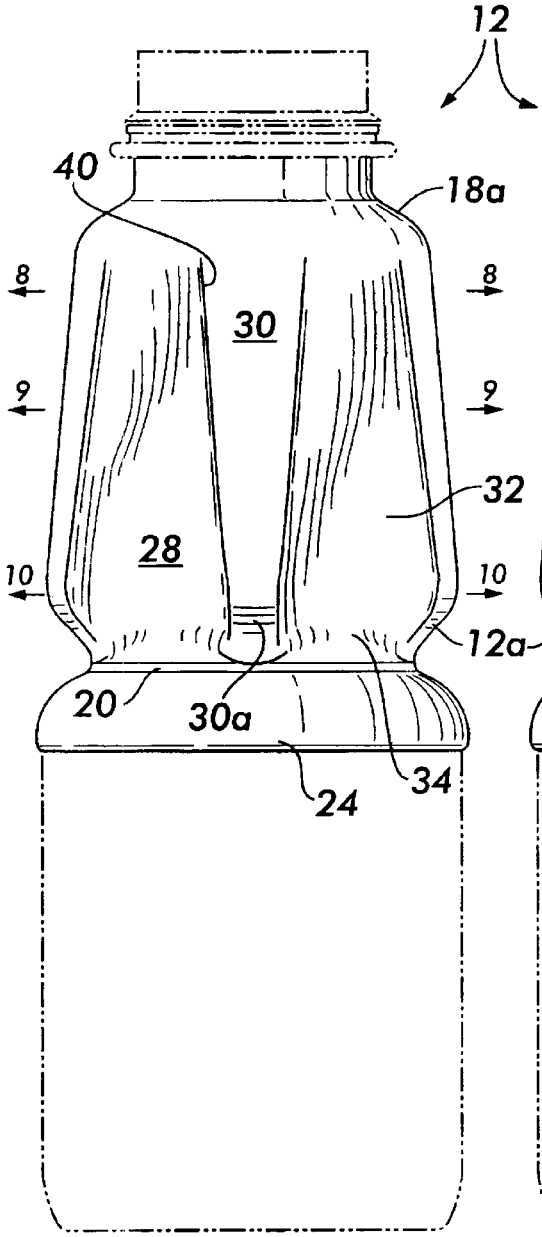
FIG. 6 is an elevational view of the container illustrated in FIG. 5.
Figure 7:
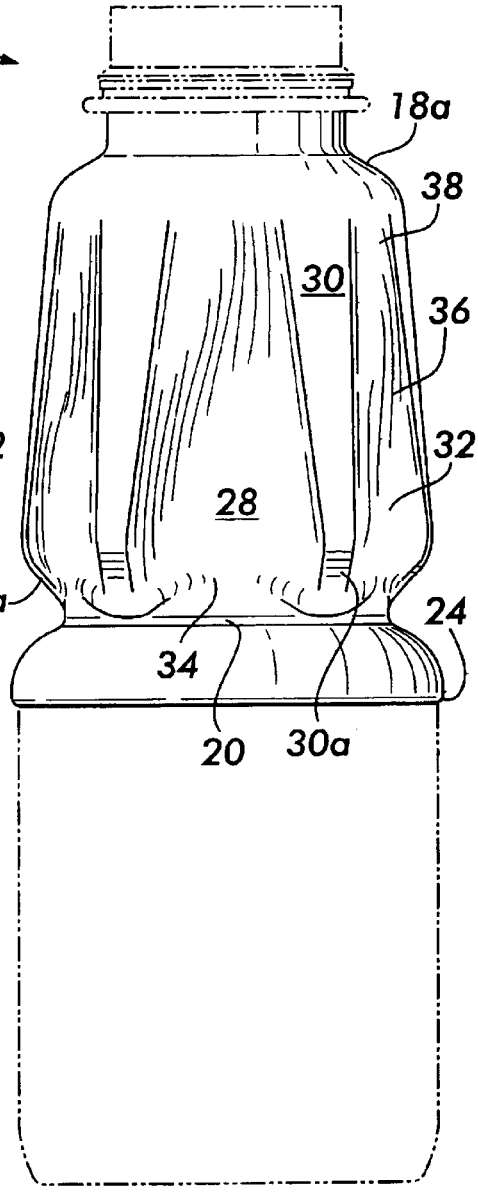
FIG. 7 is an elevational view of the container illustrated in FIG. 6 having been rotated 36° about the longitudinal axis of the container.
Figure 8:
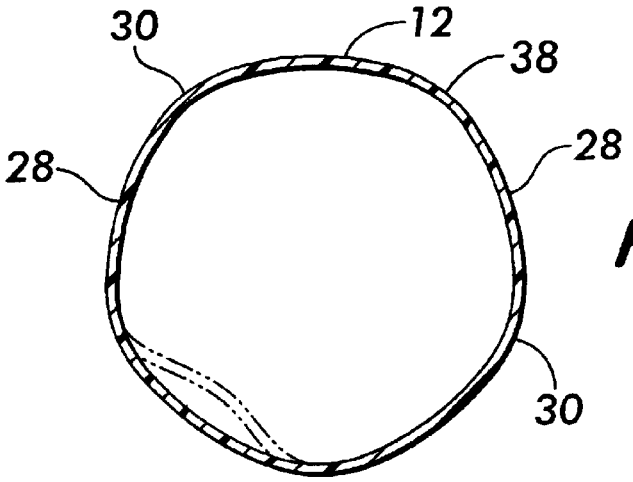
FIG. 8 is a cross-sectional view taken transversely of the container dome along line 8—8 of FIG. 6.
Figure 9:
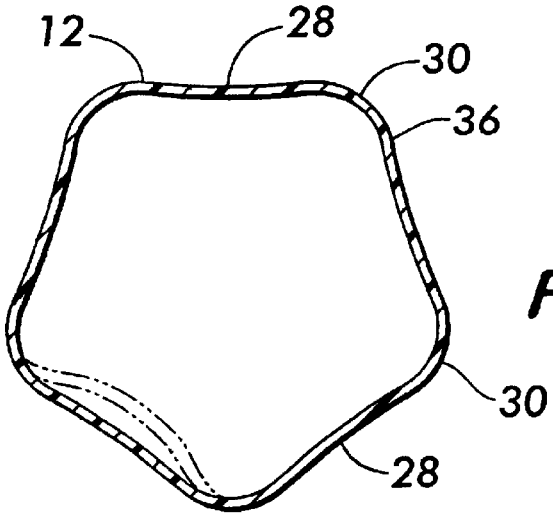
FIG. 9 is a cross-sectional view taken transversely of the container dome along line 9—9 of FIG. 6.
Figure 10:
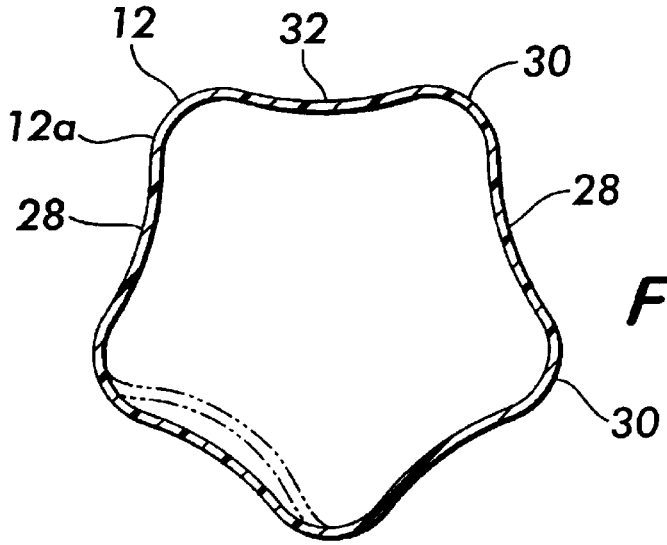
FIG. 10 is a cross-sectional view taken transversely of the container dome along line 10—10 of FIG. 6.

The dome 12 of the bottle 10 illustrated in FIG. 1 is also shown in FIGS. 5–7 utilizing an alternate style of shading lines to better show the contour of the panels 28, as formed. The contour of the panels 28 is also illustrated in FIGS. 8–10 in which: a lower section 32 is shown as bowing inwardly in FIG. 8; an upper section 38 is shown as bowing outwardly in FIG. 10; and intermediate the upper and lower ends, the panels 28 are shown as being substantially planar in FIG. 9. For ease of illustration, one panel 28 in each of FIGS. 8–10 is shown with dashed lines in a flexed position that the panel assumes after the bottle 10 is hot-filled, capped and cooled. Of course, all panels in the preferred embodiment would assume the illustrated flexed position.

From the foregoing, it should be apparent that the present invention provides a hot-fillable, grippable, slender container which integrates various functional and aesthetic features without clearly segregating these features. Unframed panels and columns interact to provide vacuum absorption functions and structural reinforcement functions. As more vacuum develops in the container, greater structural changes occur in the dome of the container to provide a container which is functional, structurally strong and aesthetically pleasing to the consumer. An inset waist, or grip ring, enables ready single-handed gripping of the container and resists ovalization of the bottle.

While a preferred embodiment of a container having a dome with unframed flex panels has been described, various modifications, alterations, and changes may be made without departing from the spirit and scope of the present invention as defined in the appended claims.

What is claimed is:

1. A blow-molded, hot-fill bottle having a longitudinal axis, said bottle including a body having a base closing one end of said bottle, a sidewall projecting from said base, and a dome with a finish located at an opposite end of said bottle, the improvement comprising:

a plurality of upright columns in said dome extending lengthwise of said dome in spaced relation; and a plurality of recessed flex panels in said dome extending between said upright columns, selected one of said recessed panels including an outwardly concave initiator portion, and the remainder of each of said flex panels being progressively less outwardly concave in a longitudinal direction, as formed, and being adapted to flex in response to vacuum induced in the bottle;

said flex panels accommodating vacuum induced in the bottle as a result of hot-fill processing.

2. A bottle according to claim 1, wherein each of said panels bows outwardly in a direction longitudinally away from said initiator.

3. A bottle according to claim 2, wherein said initiator portions function to cause flex panel deflection to occur progressively in a direction from said outwardly concave portions toward said finish in a controlled manner in response to increasing reduction of internal volume of the bottle.

4. A bottle according to claim 3, wherein said body includes a waist connecting the dome and sidewall;

said columns being circumferentially-spaced and said flex panels being circumferentially spaced and extending laterally between and connecting to an adjacent pair of said columns, each of said panels flexing inwardly in response to a reduction in internal volume when the bottle is hot-filled, capped and permitted to cool for accommodating at least about 90% of a total vacuum absorption required of the bottle; and said sidewall being reinforced to resist any significant flexure in response to vacuum induced in the bottle as a result of hot-fill processing.

5. A bottle according to claim 4, wherein, as formed, each column extending along opposite sides of each said panels has a lower end merging into said waist, and the flex panel between said columns is outwardly concave adjacent said waist to provide finger receiving recesses.

6. A bottle according to claim 5, wherein each flex panel narrows peripherally in an upward direction and each column widens peripherally in an upward direction.

7. A bottle according to claim 6, wherein said waist is an inset circumferentially-extending grip ring extending between and connecting said dome and said sidewall.

8. A bottle according to claim 1, wherein each of said plurality of panels extend and merge directly into adjacent columns without transitional framing walls.

9. A bottle according to claim 8, wherein said panels extend laterally from said columns such that an obtuse angle is formed between said panel and said column at each panel-to-column juncture on an internal side of said bottle, and wherein said obtuse angle varies progressively along the length of each of said panel-to-column junctures.

10. A bottle according to claim 9, wherein, as formed, each of said columns widens progressively in an upward direction and their associated flex panel narrows in an upward direction, said obtuse angle at each of said junctures varies along its length with said obtuse angle being greatest where said juncture extends within an upper portion of said body nearer to said finish than to said base and being least where said juncture extends within a lower portion of said body nearer to said base than to said finish.

* * * * *